US005456272A

United States Patent [19]

Johnson

[11] Patent Number: 5,456,272

[45] Date of Patent: Oct. 10, 1995

[54] HAIR BRAIDING DEVICE

[76] Inventor: Michelle D. Johnson, 2312 Algonquin Rd. #3, Rolling Meadows, Ill. 60008

[21] Appl. No.: 231,290

[22] Filed: Apr. 22, 1994

[51] Int. Cl.[6] ..... A45D 7/02; A45D 19/18

[52] U.S. Cl. ..... 132/212; 132/270

[58] Field of Search ..... 87/8, 33; 132/200, 132/212, 210, 270; 54/76, 1

[56] References Cited

U.S. PATENT DOCUMENTS

| | | | |
|---|---|---|---|
| 3,889,692 | 6/1975 | Redrow | 132/210 |
| 4,369,690 | 1/1983 | Sapkus | 87/33 |
| 4,583,561 | 4/1986 | Larsson | 132/212 |
| 4,893,543 | 1/1990 | Phillips | 87/34 |

*Primary Examiner*—John G. Weiss
*Assistant Examiner*—Elise P. Speaks
*Attorney, Agent, or Firm*—Barbara R. Greenberg

[57] ABSTRACT

A hair braiding device having a plurality of arms spaced in a tapered manner with the widest space at the arm's distal ends, the inner arms being of a substantially one piece V-shaped construction having connecting means at the distal ends and the outer arms having distal portions bent obliquely away from the outer arm linear shank portions which have perimeters which expand into parallel, oppositely disposed ear portions containing centrally disposed, aligned holes to be pivotally connected to inner arm apex holes with pins having coiled springs attached where the spring's free ends are secured by the outer surface of the inner arm apex and the inner surface of outer arm handles which are proximal extensions of the outer arm ear portions, so that pressure on the handles opens the arms to receive hair strands and release of the pressure causes the arms to close and clamp the hair strands so a hair braider is able to tighten a braided portion by pressing the hair braiding device against the braid and the hair braider can leave the braid while the hair braiding device holds the braid together and keeps the hair strands separated. A method for using the hair braiding device for the formation of three strand and two strand braids is also disclosed.

9 Claims, 2 Drawing Sheets

HAIR BRAIDING DEVICE

FIELD OF THE INVENTION

This invention relates to the field of braiding, and more particularly to hand operated, clamping, hair braiding devices.

BACKGROUND OF THE INVENTION

Since the times of early Greek and Roman history, American Indian civilization and the present era, hair braiding has always been an important aspect of professional and amateur hair styling. Patents which show tools and devices for hair braiding and hair styling include:

U.S. Pat. No. 5,240,017 to Terwilliger showing a clamp extension fixed along a comb back for the formation of braids and similar hair styles, where the clamp holds a hair section apart from other sections being braided but does not provide a means for clamping two or three hair strands to produce different braid types at the same time that the braid is tightly held;

U.S. Pat. No. 4,369,690 to Sopkus showing a gear operated hair braiding apparatus where strands of hair are placed in tubular members which are moved by pressure on a gear mechanism to produce only one type of hair braid;

U.S. Pat. No. 2,194,826 to Franco, et.al. showing a four pronged hairpin having a plurality of tines where the outer ends of the tines are compressed, inserted into the hair and released so that the tines spread apart and then Grasp the hair which is the opposite of the present invention where arms compress to grasp the hair, and, in addition, the hairpin cannot be used for hair braiding;

U.S. Pat. No. 1,252,936 to Noyes showing a four pronged hair pin where the outer prongs have waves that hold the hair pin in the hair but without any hair braiding abilities; and U.S. Pat. No. 913,061 to Shaw showing a four pronged hair pin having inner prongs which spring back together after insertion to grip the hair between the prongs but without any hair braiding capacity.

No hair braiding device exists which allows the braider to not only produce a simple three strand braid but also French, fishtail and rope braids or any combination of these braids without having to hold and at the same time manipulate the needed hair strands. With the present invention Hair Braiding Device, the user can quickly and easily make a variety of braids with hands left free to bring additional hair strands into the braid and without handling clips or combs to maintain the braid formation. The Hair Braiding Device makes braiding simple even for a young child. Also, if for any reason, the braider must stop and leave the braid during the braiding operation, the formed braid will not fall apart but remains together and tight until braiding is resumed. The Hair Braiding Device acts as a third hand to separate unbraided hair strands while keeping them untangled and to hold the braided strands together.

It is an object of the invention to provide a simple, hand held, hair braiding device that will aid users of all ages to quickly and easily produce a basic three strand braid, a French braid, a fishtail braid and a rope braid for another person or for oneself.

It is another object of the invention to provide a hair braiding device where the braider can stop at any time before completion of the braid when the device is in place and the braid will remain tight and intact.

Further, it is an object of the invention to provide a hair braiding device that tightens the braid as the braiding process proceeds, keeps the hair strands separate and untangled and does not painfully pull the hair as it is braided.

Finally, it is an object of the invention to provide an economical hair braiding device for use by professional hairdressers and individuals where the device can be used on another person or on the person doing the braiding.

SUMMARY OF THE INVENTION

The abovementioned and other objects of the invention are achieved by providing a hair braiding device having a plurality of arms spaced in a tapered manner with the greatest space between the distal arm portions and the least space just before the arms are joined at an apex, where two inner arms comprising a substantially one piece V-shaped construction have hinging means at distal rounded open ends and two separate, substantially identical mirror image outer arms have distal portions bent obliquely away from the inner arms; the four arms being joined at the inner arm apex where the outer arms expand into parallel, oppositely disposed ear portion that surround the inner arm apex, the ear portions having central holes aligned with inner arm apex holes to receive pins having coiled springs attached so the outer mirror image arms are pivotally attached to the V-shaped inner arms beyond which the outer arms extend to form handle portions; the coiled springs having a plurality of coils with one free end inclined away from the axis of the springs and adjacent to and secured by the outer arm handles and the other free end inclined away from the axis of the springs and adjacent to and secured by the inner arm outside apex surface, thus arranged so that pressure on the outer arm handles causes coiled spring torsion that separates the outer arms from the inner arms and creates spaces for easy insertion of hair strands and pressure release on the outer arm handles causes spring torsion release and allows the outer arms to spring back toward the inner arms and clamp the inserted hair strands. A braid is started below the Hair Braiding Device, the device is removed and reinserted below the braided portion clamping the unbraided hair strands and pressing the braided portion which is tightened and the process is repeated. If preferred, a braid can be started without the Hair Braiding Device, the device can be inserted below the braid and used to tighten the braid and hold unbraided hair strands at any point in the braiding process. Whenever the Hair Braiding Device is in the hair in the clamped position, the braider can stop braiding or manipulate other strands of hair to be used in the braid. The braider can use two Hair Braiding Devices on one braid, one device to hold the hair strands and keep the braid tight while the other device is removed. The braider can use more than one Hair Braiding Device at the same time creating separate braids for the same individual or joining separate braids into one braid. Also, the braider can start a braid at any place on an individual's head where braiding might be awkward due to short hair lengths since the Hair Braiding Device clamping arms will hold even short hair strands keeping them separate and the braider's hands are free to insert new strands into the braid. Finally, the Hair Braiding Device can be used in the unhinged mode for braids requiring three strands of hair and in the hinged mode for braids requiring two strands of hair.

DETAILED DESCRIPTION OF THE INVENTION

Figure 2:
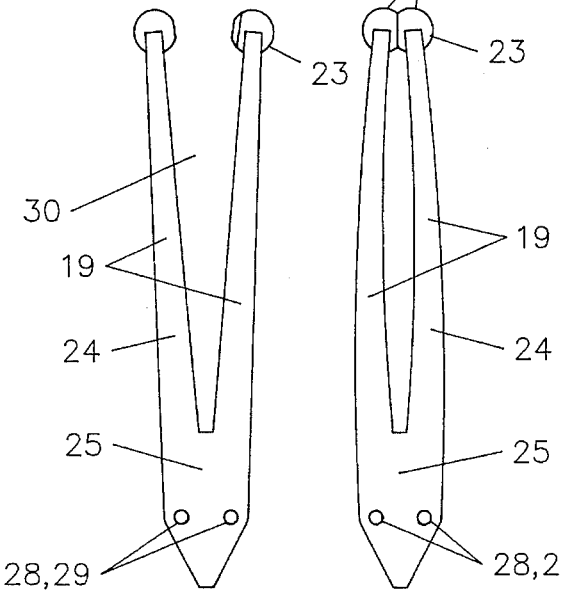
FIG. 2 is a top plan view of the inner arms in the open position and FIG. 2A is the same view of the inner arms in the closed position.
Figure 1:
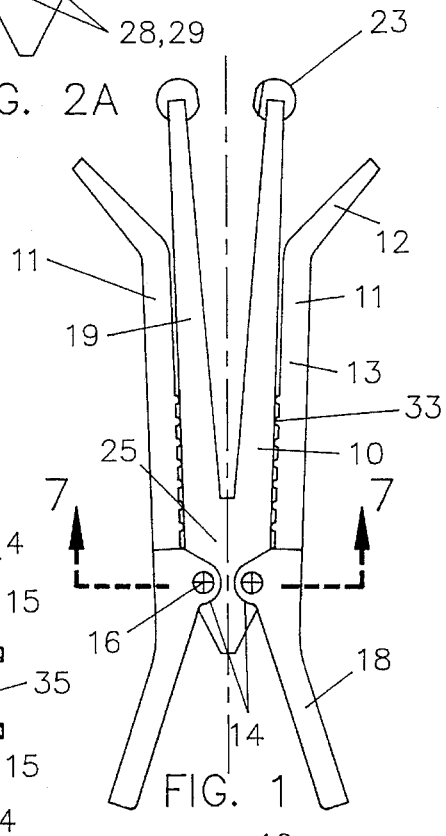
FIG. 1 is a top plan view of an embodiment of the invention.
Figure 7:
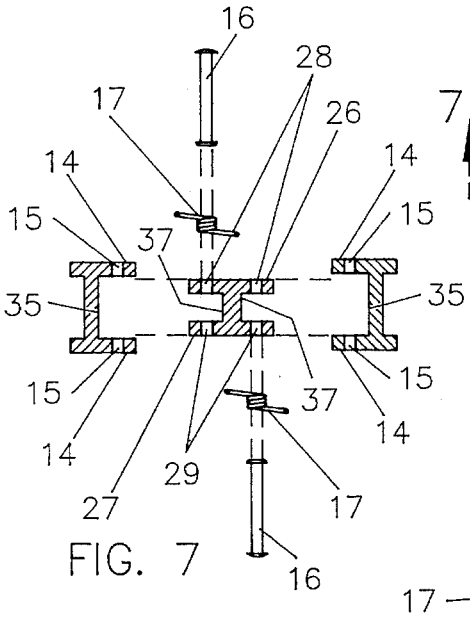
FIG. 7 is an exploded horizontal cross section view taken on line 7—7 of FIG. 1.
Figure 6:
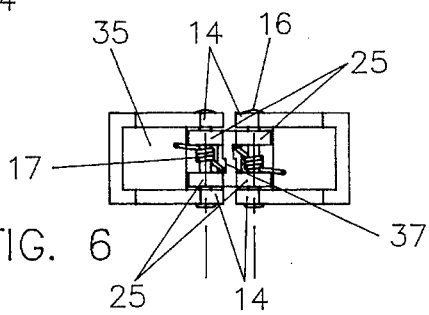
FIG. 6 is a front end view of of the embodiment of FIG. 1.
Figure 5:
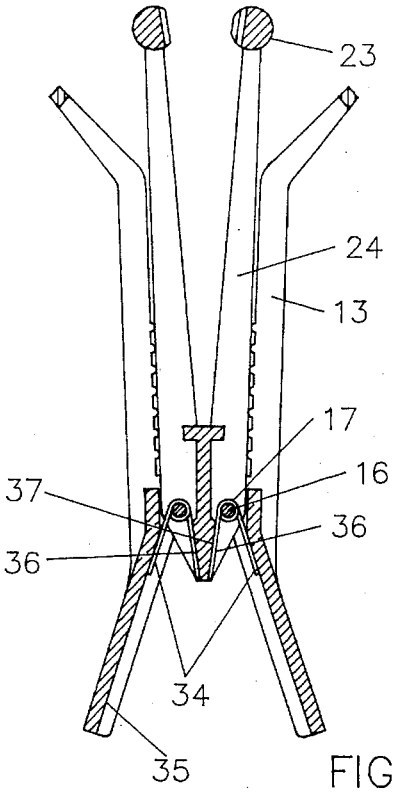
FIG. 5 is a longitudinal cross section view taken on line 5—5 of FIG. 4 showing an embodiment of the invention in the closed position and FIG. 5A is the same view of the invention in the open position.

Referring now to the drawings, wherein like reference numerals refer to like or corresponding parts throughout the several views, in particular, FIG. 1 illustrates a top and bottom view of a Hair Braiding Device 10 comprising, two generally identically configured mirror image outer arms 11, each outer arm 11 preferably of one piece construction having a distal outwardly bent portion 12 connected to a supporting linear shank 13 which is preferably at least twice as long as the distal bent portion 12, and where in the preferred embodiment the angle of the distal bent portion 12 is no more than forty five degrees in reference to the shank 13, the shank 13 having a linear perimeter that expands to parallel oppositely disposed ear portions 14, see FIGS. 1,7, each ear portion 14 containing a centrally located hole 15 positioned to receive a pin 16 around which a coil spring 17 is attached, see FIGS. 5,6,7, the outer arm 11 continuing to a proximal clamping handle portion 18; and comprising two inner arms 19 illustrated in FIGS. 1,2 formed from a V-shaped construction where each inner arm has a rounded distal end 20 that may be formed by affixing a solid sphere 23 for easy insertion into thick, coarse or curly hair, a shank portion 24, and a proximal base 25 having a top wall 26 and a bottom wall 27 as shown in FIG. 7, each wall having a plurality of oppositely disposed holes 28,29 where the top wall 26 holes 28 are aligned with the bottom wall 27 holes 29 and with the outer arm holes 15, the aligned holes all positioned to receive the pin 16 that pivotally connects outer arms 11 to the inner arms 19, specifically the outer arms 11 ear portions 14 to the inner arm proximal base 25.

Figure 2A:
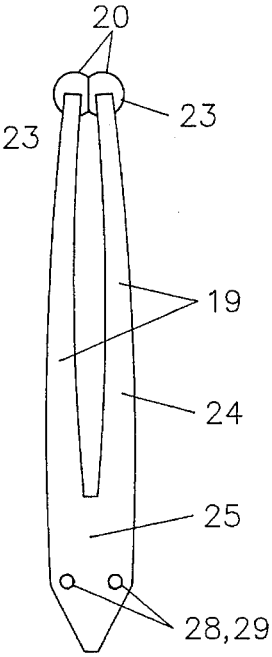

FIG. 2 illustrates the inner arm 19 V-shaped construction showing a central, tapered space 30 that reaches a maximum width at the inner arms rounded distal ends 20 of preferably at least one inch and FIG. 2A shows the inner arm distal rounded ends 20 in a closed position to eliminate the distal portion of the central tapered space 30 for hair braiding that requires two hair strands.

Figure 3:
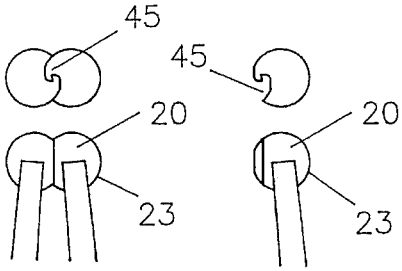
FIG. 3 is a top view of the inner arms distal portions showing the connecting means.

FIG. 3 shows a connecting means 45 for the inner arms rounded distal ends 20 comprising solid spheres 23 with notched, hook shaped connecting means 45 that preserve the rounded end configuration so the Hair Braiding Device can be easily inserted into the hair. Other connecting means such as a hook attached to one sphere 23 and an eve attached to the other sphere 23 will also serve to eliminate the central tapered space 30 distal end.

Figure 4:
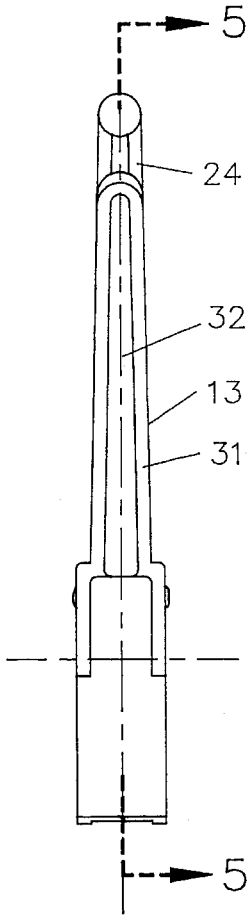
FIG. 4 is a side elevation view of the invention.
Figure 5A:
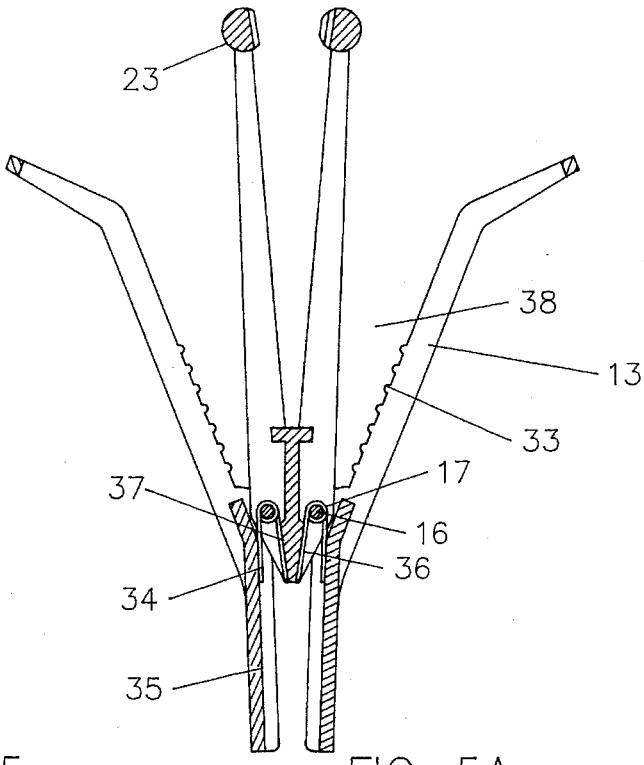

Moving on to FIG. 4, a side view of the Hair Braiding Device 10 shows the outer arm shank portion 13 and inner arm shank portion 24 having a wire perimeter 31 construction with a central open space 32. The wire is preferably of eight to ten gauge size. In another embodiment, the outer arm shank portion 13 and the inner arm shank portion 24 are solid plates having flat surfaces. In still another embodiment, the inner arm shank portion 24 is a solid plate having an outer depressed surface adjacent to the outer arm shank portion 13 inner surface. In the preferred embodiment, the outer arm shank portion has ridges 33 on the surface adjacent to the inner arm shank portion 24 as is illustrated in FIGS. 5, 5A. FIGS. 5 and 5A are longitudinal sectional views taken on line 5—5 of FIG. 4. FIG. 5 shows the Hair Braiding Device 10 in a closed position and FIG. 5A shows the Hair Braiding Device in the open position ready to receive hair strands. When the Hair Braiding Device is closed, FIG. 5, each coil spring 17, consisting of a plurality of coils wound around the pin 16, has one free end portion 34 inclined away from the axis of the coiled spring 17 so that the free end portion 34 is adjacent to and secured by an outer arm clamping handle 18 inner depressed surface 35 and the other coiled spring 17 free end portion 36 is inclined away from the coiled spring 17 so that it is adjacent to and secured by an inner arm base portion outside depressed surface 37. Both coiled springs 17 act in the closed position, FIG. 5, to continually urge the inner surface of the outer arm shank portions 13 toward the outer surfaces of the inner arm shank portions 24 so these surfaces are adjacent to each other in the closed position. In the open position, FIG. 5A, pressing the outer arm clamping handles 18 toward one another creates torsion in the coiled springs 17 that causes the outer arm shank portions 13 to separate from the inner arm shank portions 24 and, thereby, provide spaces 38 to receive hair strands. The torsion created in the coiled springs 17 opposes the separation of the shank portions. Upon release of pressure on the outer arm clamping handles 18, the outer arm shank portions 13 will spring back toward the inner arm shank portions 24 and, as a result, clamp the hair strands in the spaces 38 provided. Since two coiled springs are provided in the preferred embodiment, the amount of pressure exerted on each outer arm clamping handles 18 will determine the size of spaces 38 so that each space 38 may be the same size or of different sizes depending on thickness of the hair strands that the user is working with to produce a braid. There can be an alternate arrangement where one coiled spring is placed between the outer arm clamping handles 18 but in that case pressure exerted on the handles would result only in equal size spaces 38 to receive equal size hair strands. Also, the Hair Braiding Device 10 with two coiled springs 17 allows the user to produce each space 38 independently of the other so the user can work with one hair strand at a time. In addition, either in the closed or open position, FIGS. 5, 5A show that the inner arms distal ends 20 extend beyond the outer arm distal ends 12 for easy insertion of the Hair Braiding Device 10.

In FIG. 6, a front view of the Hair Braiding Device 10, there is shown the pins 16 pivotally connecting the outer arm ear portions 14 with the inner arm base portions 25 and with the coiled springs 17 disposed around the pins 16.

FIG. 7 shows an exploded horizontal section taken along line 7—7 of FIG. 6 where outer arm 11 holes 15 are shown aligned with inner arm 19 holes 28,29 to receive pin 16 around which the coiled spring 17 is attached.

Figure 8:
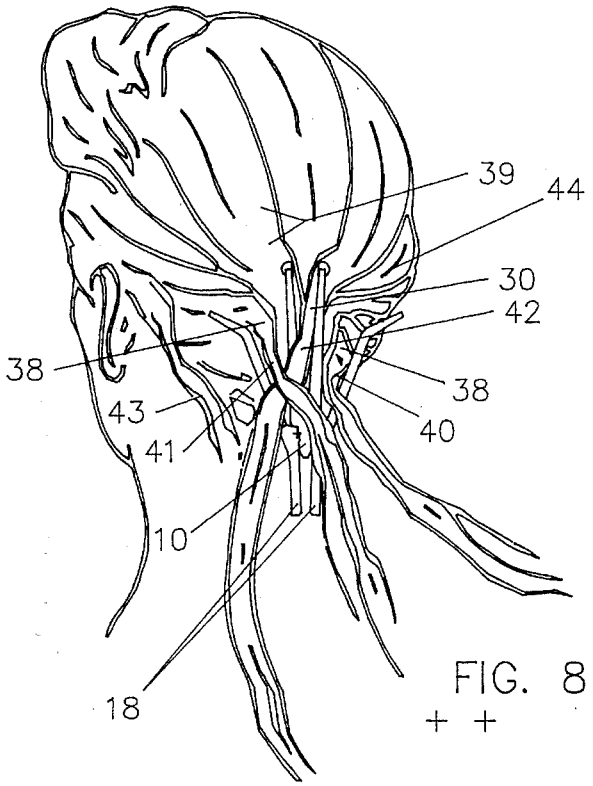
FIG. 8 illustrates the insertion of the invention into the hair in the open position.

In reference to FIG. 8, the Hair Braiding Device 10 is inserted from under the hair 39 to be braided where the device distal ends are pushed through the hair, then the Hair Braiding Device is pressed to the open position, FIGS. 5A,8, and right hair strand 40 and left hair strand 41 are placed in spaces 38 while center hair strand 42 is placed in space 30. Then pressure on the outer arm handles 18 is released and the arms 11, 19 close to clamp the separate hair strands 40, 41, 42 leaving the Hair Braiding Device 10 in the hair where it no longer needs to be held and the user's hands are freed to handle other hair strands, combs or clips as needed to produce the desired braid and hair style. In addition, the braider can use two Hair Braiding Devices 10 on one braid where one device is clamped to hold the newly braided portion while the other device is removed.

To produce the simple three strand braid, three hair strands 40, 41, 42 are selected, and the open Hair Braiding Device 10 is inserted into the hair before a braid is started as illustrated in FIG. 8, or if a braid is already started, the open Hair Braiding Device 10 distal ends 12, 20 are inserted to receive the unbraided hair strands. Then the hair braiding device 10 is closed to hold the hair strands. Next the braid is formed when the left hair strand 41 is crossed over the center hair strand 42 and then the right hair strand 40 is crossed over the newly created center hair strand. The Hair Braiding Device 10 is pressed to the open position, FIG. 5A, slipped out of the hair and then reinserted beyond the braided portion to again clamp the three hair strands 40, 41, 42. The Hair Braiding Device 10 is pressed against the formed braid to tighten the braid and the braiding process is repeated until the three hair strands 40, 41, 42 are braided.

To produce the simple three strand braid, the Hair Braiding Device 10 is inserted into the hair as illustrated in FIG. 8 or if a braid is already started, the Hair Braiding Device 10 distal ends 12, 20, are inserted to receive the unbraided hair strands, and the left hair strand 41 is crossed over the center hair strand 42. Next the right hair strand 40 is crossed over the newly created center hair strand 41. The Hair Braiding Device 10 is pressed to the open position, FIG. 5A, slipped out of the hair and then reinserted beyond the braided portion to again clamp the three hair strands 40, 41, 42. The Hair Braiding Device 10 is pressed against the formed braid to tighten the braid and the braiding process is repeated until all of the hair is braided.

To form a French braid, a basic three strand braid is started. Then the Hair Braiding Device 10 is opened, FIG. 5A, and inserted from underneath the three hair strands 40, 41, 42 below the basic three strand braid where the Hair Braiding Device 10 is closed, FIG. 5, to clamp the three hair strands. Now the user's hands are free to add additional hair from the left side of the head 43 to the left hair strand 41 which is then crossed over the center hair strand 42, and then the user adds additional hair from the right side of the head 44 to the right hair strand 40 and crosses it over the newly created center hair strand 41. Next, the Hair Braiding Device 10 is removed and reinserted under the hair beyond the braided portion and the process is repeated until all of the hair is French braided. In addition, the rope braid may be formed using the French braid process but crossing the right hair strand 40 and left hair strand 41 alternately under the center hair strand 42.

In the fish tail braid, two hair strands 40, 41 are needed so the centered tapered space 30 distal portion of the Hair Braiding Device 10 is closed using the connecting means 31 as shown in FIG. 3. A fish tail braid is started where a segment from underneath left hair strand 41 is placed with right hair strand 40 and a segment from underneath right hair strand 40 is placed with left hair strand 41. Then the Hair Braiding Device 10 is opened, FIG. 5A, and inserted from below the hair 39 so that the right hair strand 40 and the left hair strand 41 are placed in spaces 38 and the Hair Braiding Device 10 is closed, FIG. 5. The fish tail braid is continued when a small section of hair is separated from underneath the left hair strand 41 and is placed with the right hair strand 40. Then a small section of hair is separated from underneath the right hair strand 40 and and placed with the left hair strand 41. Pressing on the outer arm handle portions 18 can vary spaces 38 so the hair strands 40, 41, can be manipulated. Next, the Hair Braiding Device 10 is opened, removed and reinserted below the braided portion where the braided portion is tightened by pressing the device 10 against the braided portion. Additional hair from the left side 43 of the head is added to the left hair strand 41 and from the right side of the head 44 is added to the right hair strand 40. Then the process is repeated until all of the strands 40,41, are braided.

In accordance with the present invention, a single embodiment has been described and illustrated. Nevertheless, it will be understood that the invention is not limited to the embodiment fully disclosed but extends to a wide range of equivalents without departing from the spirit and scope of the invention. For example, scale changes will allow the present invention uses to expand where a small version can be used for doll's hair and a larger version can be used for animal hair, such as a horse's mane or tail hair. Also, the present invention can be modified by adding additional arms added having a spring means to open the arms and create spaces to hold more than three hair strands. The Hair Braiding Device 10 can be used to braid cord, string, thread such as heavy carpet thread and other materials used for purposes other than hair styling and can also be used for weaving. The present invention works best when constructed of a resilient material such as steel or polypropylene but other alloys and plastic materials can be used with equal success.

I claim:

1. In a hair braiding device, a combination comprising:

outer arms, each arm having a distal bent portion, a linear shank shank portion that has a perimeter that expands to form oppositely disposed, parallel ear portions having central holes, and a proximal clamping handle portion;

inner arms of a V-shaped construction, each arm having a rounded distal end, a shank portion joined to a proximal base portion having a top wall and a bottom wall, each wall with oppositely disposed holes where top wall holes are aligned with bottom wall holes:

pin connecting means having pins inserted into the outer arm ear central holes and inner arm base portion top wall and bottom wall aligned holes, thereby pivotally connecting the outer arms to the inner arms;

opening and closing means comprising a coiled spring and handle where pressure applied to outer arm handle portions will separate outer arm and inner arm adjacent surfaces and provide spaces to receive hair strands that will remain clamped in the spaces provided when pressure is released on the outer arm handle portions allowing the outer arms and inner arms to spring together.

2. The combination according to claim 1 wherein the device has two generally identical mirror image outer arms each having a distal portion bent outwardly at an angle of no more than forty five degrees with reference to the outer arm shank portion.

3. The combination according to claim 1 wherein each outer arm shank portion is at lease twice as long as each distal outwardly bent outer arm portion.

4. The combination according to claim 1 wherein each inner arm rounded distal end is a hook shaped, notched solid sphere providing connecting means for the inner arm distal ends.

5. The combination according to claim 1 wherein a coiled spring consists of a plurality of coils wound around a pin, where a coiled spring free end portion is inclined away from the axis of the coiled spring so that the coiled spring free end portion is adjacent to and secured by an outer arm clamping handle inner depressed surface and the other coiled spring free end portion is adjacent to and secured by an inner arm outside depressed surface.

6. A method for braiding hair comprising the steps of:

selecting the hair strands to be braided;

starting a braid;

inserting an open hair braiding device below a braided portion where the hair strands from the braided portion are received in spaces provided;

closing the hair braiding device to hold the hair strands;

pressing the hair braiding device against the formed braid to tighten the braid;

continuing the braid below the hair braiding device by crossing alternately outer hair strands over a center hair strand;

removing the hair braiding device; and reinserting the device below the braided portion where the process is repeated.

7. The method of claim 6 further comprising the steps of:

adding additional hair from the right side of the head to a right hair strand each time the right strand is used to produce the braid, and adding additional hair from the left side of the head to a left hair strand each time the left strand is used to produce the braid.

8. The method of claim 6 comprising the additional steps of:

connecting hair braiding device inner arm distal ends to close a space between the inner arm distal ends;

selecting a right and a left hair strand to be braided;

placing a segment of hair from underneath the left hair strand with the right hair strand and Placing a segment of hair from underneath the right hair strand with the left hair strand to start a fish tail braid;

inserting the open hair braiding device from below the hair so the right hair strand and left hair strand are placed in right and left hair braiding device open spaces;

closing the hair braiding device to clamp the strands;

tightening the braided portion by pressing the hair braiding device against the formed braid; and repeating the process until all of the strand portions are braided.

9. The method of claim 6 where an open hair braiding device is initially inserted in the hair receiving hair strands before a braid is started so that the braid is started below the hair braiding device.

* * * * *